US011530837B2

(12) United States Patent
Larsson

(10) Patent No.: US 11,530,837 B2
(45) Date of Patent: Dec. 20, 2022

(54) AIR TERMINAL DEVICE FOR CONTROL OF AIR FLOW IN A VENTILATION SYSTEM

(71) Applicant: Swegon Operations AB, Kvänum (SE)

(72) Inventor: Per Åke Larsson, Västra Ämtervik (SE)

(73) Assignee: SWEGON OPERATIONS AB, Kvänum (SE)

( * ) Notice: Subject to any disclaimer, the term of this patent is extended or adjusted under 35 U.S.C. 154(b) by 788 days.

(21) Appl. No.: 16/379,404

(22) Filed: Apr. 9, 2019

(65) Prior Publication Data

US 2019/0309962 A1 Oct. 10, 2019

(30) Foreign Application Priority Data

Apr. 9, 2018 (SE) ..... 1830118-4

(51) Int. Cl.
*F24F 1/0014* (2019.01)
*F24F 11/72* (2018.01)
(Continued)

(52) U.S. Cl.
CPC ..... *F24F 11/72* (2018.01); *F24F 1/0011* (2013.01); *F24F 1/0014* (2013.01);
(Continued)

(58) Field of Classification Search
CPC ..... F24F 11/72; F24F 1/0035; F24F 1/0063; F24F 1/0011; F24F 1/0014; F24F 1/01;
(Continued)

(56) References Cited

U.S. PATENT DOCUMENTS

2009/0098820 A1 4/2009 Yabu
2009/0277204 A1 11/2009 Heuer et al.
(Continued)

FOREIGN PATENT DOCUMENTS

CH 57712 A 2/1913
DE 7924975 U1 6/1978
(Continued)

OTHER PUBLICATIONS

Isaka, Kinji, JPH09113022 Translation.pdf, "Air volume controller", May 1997, pp. 1-6.*
(Continued)

*Primary Examiner* — Avinash A Savani
*Assistant Examiner* — Ryan L Faulkner
(74) *Attorney, Agent, or Firm* — Nixon & Vanderhye

(57) ABSTRACT

Disclosed is an air terminal device for a ventilation system for a building. The air terminal device includes a pressure box, with an inlet admitting supply air into the pressure box and outlet openings for admitting supply air out. The device further includes first and second cover plates, each arranged to control and change the open area of a plurality of the outlet openings. The outlet openings are arranged in a wall of the pressure box forming an outlet surface of the pressure box. The cover plate or cover plates are arranged to be in contact with and slide relative the outlet surface while changing the open area of the outlet openings. The first cover plate and the second cover plate are arranged to slide relative each other and to be in contact with and slide relative the outlet surface while changing the open area of the outlet openings.

19 Claims, 4 Drawing Sheets

(51) Int. Cl.

| | |
|---|---|
| ***F24F 13/10*** | (2006.01) |
| ***F24F 1/0035*** | (2019.01) |
| ***F24F 1/0063*** | (2019.01) |
| ***F24F 1/01*** | (2011.01) |
| ***F24F 13/06*** | (2006.01) |
| ***F24F 13/12*** | (2006.01) |
| ***F24F 13/26*** | (2006.01) |
| ***F24F 1/0011*** | (2019.01) |
| *F24F 13/02* | (2006.01) |

(52) U.S. Cl.
CPC ..... *F24F 1/0035* (2019.02); *F24F 1/0063* (2019.02); *F24F 1/01* (2013.01); *F24F 13/06* (2013.01); *F24F 13/10* (2013.01); *F24F 13/12* (2013.01); *F24F 13/26* (2013.01); *F24F 13/0236* (2013.01); *F24F 2013/0616* (2013.01)

(58) Field of Classification Search
CPC .. F24F 13/06; F24F 13/10; F24F 13/12; F24F 13/26; F24F 13/0236; F24F 2013/0616; F24F 13/1426; F24F 2013/1473
USPC ..... 454/237
See application file for complete search history.

(56) References Cited

U.S. PATENT DOCUMENTS

| | | | | |
|---|---|---|---|---|
| 2014/0030976 | A1* | 1/2014 | Spalding ..... | F24F 13/06 454/347 |
| 2018/0187904 | A1 | 7/2018 | Nilsson | |

FOREIGN PATENT DOCUMENTS

| | | | |
|---|---|---|---|
| EP | 1918650 | A2 | 5/2008 |
| GB | 191214128 | A | 1/1913 |
| JP | S57-191352 | U | 12/1982 |
| JP | H05-32943 | U | 4/1993 |
| JP | H10-54606 | A | 2/1998 |
| JP | 2003-014285 | A | 1/2003 |
| JP | 3516787 | B2 | 4/2004 |
| SE | 517998 | C2 | 8/2002 |
| SE | 1450434 | A1 | 10/2015 |
| SE | 540427 | C2 | 9/2018 |
| WO | 2017/048173 | A1 | 3/2017 |

OTHER PUBLICATIONS

SE Search Report, dated Oct. 18, 2018, from corresponding SE application No. 1830118-4.
Extended European Search Report issued in European Patent Application No. 19168134.5 dated Aug. 27, 2019.
Extended European Search Report issued in European Patent Application No. 19168140.2 dated Aug. 19, 2019.

* cited by examiner

AIR TERMINAL DEVICE FOR CONTROL OF AIR FLOW IN A VENTILATION SYSTEM

TECHNICAL FIELD

The present invention relates to an air terminal device for a ventilation system for a building, e.g. a Heating and Ventilating Air Conditioning (HVAC) system. The air terminal may be an air diffuser or an induction unit, with or without temperature regulating means. However, the invention is in particular suitable for induction units provided with a temperature regulating device.

BACKGROUND ART

Centralized air ventilation systems such as Heating and Air Conditioning (HVAC) systems are generally provided in all premises or larger buildings constructed today. In order to provide for desired ventilation, and generally also conditioning the air to a relevant temperature, there is a desire to control the ventilation system to provide a relevant amount of air and condition the air to be at the right temperature. A common way of controlling the supply air and conditioning the air is to use cooling beams in induction units. The cooling beam may be set to provide a desired flow of supply air by controlling the open area of the outlet openings for fresh air whereby a fresh air flow may be calculated from a known pressure difference between the different sides of the outlet openings. In an induction unit, the flow of fresh air will withdraw room air, i.e. induce an air flow, to be mixed in a mixing chamber. In general, the cooling beam is thus construed such that the induced air flow will pass a temperature regulating battery and thus heat or cool the induced air flow. Even though this kind of arrangement is commonly referred to as a cooling beam it may be used for heating or cooling of the induced air flow. These kind of air terminal units, cooling beams, may also be referred to as chilled beams, temperature regulated induction units, comfort cassettes and are commonly shaped to be quadratic or rectangular having outlets along two or all four sides.

As there is an increasing interest in providing more energy efficient ventilation systems, the ability to control the air flow in each room according to the demand, e.g. amount of fresh air and temperature, is desired to avoid unnecessary ventilation or heating. Hence, there is generally a desire to provide an air terminal device which may be automatically controlled to deliver the desired amount of air and provide a desired heating/cooling operation by regulating the air terminal device. Such devices are previously known and may for example be found in SE 517 998, which discloses a device which provide a flow in two directions, or in WO 2017/048 173 which provide a flow in four directions. These devices should thus be suitable to be used as air terminal devices in a Variable Air Volume (VAV) system wherein a variable volume of air to be ventilated to a room is controlled at the air terminal device.

In order to be able to control the air volume to correspond to the desired fresh air volume flow, and also an induced air flow if it is an induction unit, there is a desire to control the open area of the outlet openings with a desired accuracy. To precisely control the open area is in general more difficult for a terminal unit which blows in four directions, as disclosed in WO 2017/048173, than in an air terminal unit which blows only in 2 directions as disclosed in SE 517 998. As can be seen in WO 2017/048 173 the device is provided with outlet openings along all four edges. However, there is a need for rather exact tolerances and correct mounting of the cover plate in order to control the open area of the outlet openings in all directions.

Hence, there is a desire for an improved air terminal device which may better control the air flow, in particular for a terminal device having outlet openings for providing a ventilation flow in a multitude of directions.

SUMMARY OF THE INVENTION

The invention is directed to an air terminal device and a method for controlling such an air terminal device in order to regulate the air flow in a ventilation system, e.g. a Heating and Ventilation Air Conditioning (HVAC) system, in a building. The air terminal device is designed to control the air flow into a room or premise. In general, the air terminal device is located in the room. By air terminal device is intended to include all kind of devices designed to control an airflow into a room such as air diffusers which mainly function as a device which only is intended to control the air flow quantity, and possibly also the direction, of the air admitted to a room where it is mounted; induction devices which are designed to cause air from the room to be withdrawn by the supply air so as to form a mixed air stream of supply air and room air; and temperature regulating devices such as cooling beams, which may be designed as induction units, having a temperature regulating battery for cooling or heating of an air flow, e.g. the induced air flow or mixed air flow in an induction unit. Hence, the present invention may be used in any of these air terminal devices even though it is particularly suitable to be used in cooling beams and may be used to set the supply air flow to a desired level to provide a supply airflow causing a desired induction air stream of room air. The air terminal device is designed to provide control also for induction devices designed to provide airflows in a multitude of directions, e.g. for a rectangular or square shaped device having outlets along two sides, along all its four sides and providing air streams in four main directions or all along a circular edge of a round device. The air terminal device comprises a pressure box.

The pressure box may have essentially any shape and may vary in size. Hence, a pressure box is a space in which supply air above atmospheric pressure is contained. The pressure box is provided with at least one inlet for admitting supply air into the pressure box. The supply air may be provided from a central Air Handling Unit (AHU) delivering the supply air via a ventilation ducting system to the pressure box or from any suitable source. The pressure box is further provided with a plurality of outlet openings for admitting supply air out of the pressure box. The plurality of outlet openings is arranged in a wall of the pressure box forming an outlet surface of the pressure box. The outlet openings may differ in size and shape. They may for example be designed as elongated slots such that the open area of the openings may be adjusted step less to a desired size or having openings with different areas intended to be completely open or closed such that different flows may be achieved by changing which openings that are open. In order to change the air flow through the air terminal device, the air terminal device further comprises a first cover plate and a second cover plate. Each cover plate is arranged to control and change the open area of a plurality of the outlet openings. There may be further cover plates but the device includes at least two cover plates. By including at least two cover plates it will be possible to provide covering surfaces moving in different directions over the same outlet surface. This enables a more uniform control of a uniform flow pattern in different directions, e.g. when it is desired to provide an air flow from all sides in a rectangular or square shaped device. The first cover plate and the second cover plate are thus arranged to be in contact with the outlet surface in order to readily cover and close the outlet openings, either partly or completely. By arranging the cover plates to slide relative each other and the outlet surface they may move in different directions while changing the open area of the outlet openings and thus cause an essentially uniform motion for openings along different sides or direction of the outlet surface. The cover plates may for example be designed such that they move from the centre towards the edges or sides of the outlet surface in order to cover the outlet openings positioned along the sides. Depending on the design and configuration of the outlet openings and the cover plates it may be desired, and for certain configurations almost necessary, to allow the cover plates to overlap each other at least in certain configurations. By using thin cover plates it may be possible to allow the cover plates to overlap to be in contact with each other such that one cover plate slides on top of another cover plate. However, it may also be possible to design the outlet openings and cover plates such that there is no need for overlapping cover plates even though they may still be controlled to move relative each other in different directions. Hence, the cover plates may be arranged such that they overlap and are in contact with each other or such that they do not overlap nor are in contact with each other.

According to one aspect of the invention the plurality of outlet openings are arranged along one or several edges of the outlet surface. The plurality of outlet openings could for example be arranged on an outlet surface having at least four edges or sides, e.g. a quadratic or rectangular surface, and the design of the outlet openings could be designed such that there are provided outlet openings along a pair of opposing sides or along all four edges. In general, when two cover plates are used, the air terminal device is designed such that the first cover plate is arranged to control a first group of outlet openings and the second cover plate is arranged to control a second group of outlet openings such that all the outlet openings are controlled by the first and second cover plates .In the case of a square shaped or rectangular outlet surface, the first cover plate could be arranged to change the area of the outlet openings for outlet openings along a first edge and a second edge being adjacent to each other. Hence, the first plate will provide for changing the air flow along a first and second side of the air terminal device. The second cover plate may thus be arranged to change the area of the outlet openings for openings along a third edge and a fourth edge being adjacent to each other. Even though rectangular or square shaped devices is most common, the arrangement function perfectly also for other shapes such as polygons, round or elliptical for example.

In general, when there are provided outlet openings arranged along one or several edges of the outlet surface it is an advantage to change the open area of the outlet openings to be smaller by moving the cover plates towards the edge or edges of the outlet surface at which the outlet openings are located. As will be better explained below, and also in the detailed description of the drawings, may it be advantageous to cause the cover plates to move by a nonlinear motion, e.g. having a rotational motion, since this may allow the cover plates to move in different directions in an easy way.

As briefly discussed above, the outlet openings may be of different sizes and shapes. However, an advantageous shape of said plurality of outlet openings is to be shaped as elongated slits. By using slits, the distance between the edges of the opening may be rather small which may be beneficial from the view of avoiding annoying noise from the air terminal device due to the air flow while its elongated shape provide for an accurate step less increase and decrease of the open area of the outlet opening while the cover plates moves so as to cover the elongated opening from one end to the other. As will be explained in the detailed description of the drawings, by selecting the rotational motion of the cover plates in an adequate way, and using a cover plate being solid, i.e. no perforations, in the portion moving over the outlet openings, the cover plate as a whole may move relative the outlet openings such that the openings will be covered or uncovered from one end to another and the covering motion of the elongated slots will remind of a linear motion even though the cover plate moves in a non-linear, circular motion. The cover plates could of course also be moved linearly to achieve the same result. However, the use of a circular motion of the cover plates provides for a more efficient actuator arrangement even though the skilled person would understand that the use of a linear actuator also is within the scope of the inventive idea.

According to one aspect of the invention, the outlet openings are thus arranged according to a configuration which is changeable by that the at least two cover plates are arranged to change the configuration at all outlet openings simultaneously by moving the cover plates in different directions.

According to one aspect of the invention are the elongated slits arranged such that their longitudinal extension direction is angled less than 30 degrees relative its closest edge In general, the slits are arranged such that their longitudinal extension direction is essentially perpendicular to the extension direction of the closest edge.

In case it should be of interest to have a more uniform and proportional motion of the cover plate relative the slits, the slits could be made curved having a curvature corresponding to the curvature of the rotational motion of the cover plates.

However, regardless of the shape of the outlet openings may the first and second cover plates be arranged to move non-linearly, e.g. by a circular or orbital motion, when sliding in order to change the area of the outlet openings.

In order to provide for this rotational or orbital motion the first and second cover plates may be moved by a rotating actuator. According to one aspect of the invention is the rotating actuator connected to a pivotal point on the outlet surface. Attached to the pivotal point is a first actuating rod, preferably at its midpoint, and at its first end attached to the first cover plate and at its second end attached to the second cover plate. By this arrangement will there thus be a rotational force applied to each of one of the cover plates. However, the use of one single actuator, attached to a single point on each cover sheet, may not be sufficient to provide a controlled motion of the cover sheets. In order to provide for a desired controlled motion there is a need for some other guiding means. A rather easy way to provide a controlled motion is to provide the arrangement with a second actuating rod which also is attached to the outlet surface, the first cover plate and the second cover plate in a similar way as the first actuating rod and thus functioning as "slave" and mimicking and following the motion of the first actuating rod. Hence, the second actuator rod need not to be connected to the rotational actuator but will follow the motion of the first actuator due to its attachment to the cover plates and the outlet surface such that the second actuating rod will be working in the same way as the first actuating rod. In case the cover plates are rather thin and flexible it may be desired to connect the ends of the actuating rods located on the same cover plates with a reinforcement between them such that it is assured that the second actuating rod, which function as a slave actuating rod, follows the first actuating rod functioning as a master actuator. It shall be noted that there may be alternative solutions to the use of a second actuating rod for guiding the motion of the cover plates, e.g. could there be some kind of guiding pin attached to the outlet surface and fitted to a slot in the cover plates to assure a proper movement of the cover plates.

As discussed above, the arrangement described herein may be used for a number of different air terminal devices. A device suitable for the arrangement is an induction unit provided with a temperature regulating battery, e.g. a heat exchange arrangement wherein the air to be temperature conditioned is exchanging heat with a liquid heat exchanger alternatively arranged to cool or heat a through-flowing air stream. The outlet openings could thus be directed to a mixing chamber such that a stream of air from the room to be ventilated is induced by the flow of the supply air through the outlet openings and a stream of supply air is mixed with room air. A common arrangement is to arrange the temperature regulating battery such that an induced circulation of air flow from the surroundings is guided to pass through the temperature regulating battery so as to be heated or cooled. The one or several mixing chambers is arranged to mix the supply air flow and the conditioned circulated air flow to a common air stream. The common air stream is guided further to one or several outlet openings in order to flow to the room to be ventilated In a rectangular or square shaped arrangement, wherein the outlet openings form different groups of outlet openings at each side of the pressure box, could the respective group of outlet openings, one group at each side, be arranged to direct the supply air to a respective mixing chamber for directing the mixed air flow in different directions. By using the control arrangement described herein in this case may it be possible to change the configuration at all outlet openings simultaneously by moving the cover plates in different directions. Hence, supply air and the mixed air flow from the air terminal device is changeable in all directions by the same actuator causing the two cover plates to move simultaneously.

The cover plate to be used in the air terminal device is preferably made from a thin sheet material. The cover plate is therefore relatively thin and may have a thickness that falls below 2.0 mm, preferably below 1.0 mm and most preferably even below 0.6. The desired thickness of the cover plate is of course dependent of the material it is made of. According to one aspect of the invention, the cover plates are made of a thin, flexible sheet. The cover plate could for example be made of polymer material e.g. a polymer sheet. The polymer sheet to be used could have a thickness of 0.05 to 2.0 mm, more preferably between 0.10 and 1.0 mm and most preferably 0.1 to 0.6 mm. The use of such a material has a number of advantages such as reducing weight, improving the ability to provide a tight seal between the outlet surface and the cover plate due to the flexibility of the material and also making the cover plates to slide with less power needed when changing their positions. The cover plate could for example be made from a sheet material having a thickness of 0.15 to 0.60 mm.

The sheet material forming the cover plate shall preferably be selected such that the cover plate is sufficiently stiff and able to slide easily against the vent surface without folding or being wrinkled. The material chosen for the plate can therefore be a polyester film, for example Mylar® A which for example may be used in a thickness from 0,15 to 0,50 mm. The material that is used suitably has a Young's modulus that exceeds 1500 MPa according to the test method ASTM D 882 since too soft materials have a tendency to fold. In general, a sheet material having a Young's modulus of 1,000 to 20,000 MPa, preferably of 1,500 to 15,000 MPa and most preferably between 2,000 and 10,000 MPa are suitably used.

The above parameters are intended to guide the skilled person to find a relevant choice of material. However, the cover plate may be provided with reinforcements in order to provide rigidity to a sheet material in the lower range or even outside the suggested ranges while surface modifications or weakened portions may be provided to a sheet material having a Young's modulus in the upper ranges or even above to make the cover plates contact surface smoothly follow the outlet surface and cause the cover plate to be tight against the outlet surface. Hence, the cover plate shall have a sufficient rigidity and stiffness in relation to the friction that arises when the cover plate is pushed such that the cover plate does not fold, wrinkle or bend while at the same time being flexible in order to follow tight against the outlet. The cover plate, with its recessed apertures, thus has to present a sufficient bending rigidity. The bending rigidity partly depends on material and thickness, but the device includes at least two also on the aperture configuration. It is also important that the surface does not stick, i.e. the properties of the cover plate material shall not be of such character that it has a too large tendency to stick at the surface. The surface property of the material thus becomes a matter of finding a material for the cover plate that follows sufficiently tightly against the outlet surface at the same time as the cover plate does not stick too hard to the surface.

The cover plate is preferably made from a sheet material having a surface weight of less than 1 kg per square meter, more preferably of less than 0.5 kg per square meter. The weight of the cover plate may in particular be of interest if the cover plate is located in the air terminal device such that the gravity is striving to separate the cover plate from the outlet surface. Cover plates most commonly used today in similar devices are generally made from sheet metal having a considerably higher weight per square metre, about 5 to 10 times higher, than for a polymer sheet having the same thickness. Using metal as a cover plate material may thus render the sheet considerably heavier or being very thin rendering the sheet to be vulnerable to be wrinkled and/or to not be as flexible as desired. The use of polymer will thus enable in an easier way to provide cover plates having a low surface weight while being elastically deformed to follow the outlet surface.

Still another advantage by using thin, flexible sheet material is that it may easier be possible to allow the cover plates to overlap each other since the total thickness will be rather thin even though if they overlap and the flexibility of the material together with using thin sheets will make it possible to have a close fit between the outlet surface and the cover sheet even if the cover sheets overlap at some areas. This arrangement would most certain not have been possible to manage with a close fit over the outlet openings with metal sheet plate material.

Due to the sheets flexibility and possibility to adapt its shape it is not necessary to provide a cover plate made from such a material with a lot of arrangements in order to press the cover plate against the outlet surface but it may be sucked onto it and provide a tight seal by itself if it is located on the high pressure side of the outlet surface. In order to provide for a close and tight fit it may be desired that the cover plate also in its fully open position there is at least one outlet opening being partly covered by a cover plate such that the cover plate will be pressed against the outlet surface by the pressure difference between the pressure box and the surroundings also when the air terminal device is set to maximum flow.

Hence, by the flexibility and tightness of the system the present device is suitable to be used for any kind of air terminal device. It may in particular be used in VAV system due to the tightness of the seal between the outlet surface and the cover plate. Generally, there has been a desire to have an additional valve due to leakage in the air terminal device, e.g. a cooling beam, but this may be avoided with this arrangement.

The arrangement described herein may be used and controlled according to any known method and due to its robust control system and low leakage a rather exact flow may be set using known methods, e.g. to calculate a flow of supply air based on pressure measurements and K-factors for a known position of the actuator or the direct measurement of the position of the cover plates relative the outlet surface.

In the above, the invention has been exemplified specifically for air terminal devices having elongated openings located at or in the vicinity of the edges of the outlet surface. However, the basic principle on which the present invention relies is applicable to essentially any kind of air terminal device using the principle of moving a cover plate over a wall provided with holes or opening in order to allow the a flow of air from a pressure box. The use of thin and flexible cover sheets, preferably made of a suitable polymer which may adapt to the surface of the openings in the wall of a pressure box, herein referred to as outlet surface, will in spite of the general knowledge, teaching of using sheet metal for this purpose, contribute to provide an air terminal device with a cover plate being able to be forced tight against the outlet surface and thereby improving the performance and accuracy of the control of air flowing through the outlet surface in the pressure box wall as well as reducing annoying noise

DETAILED DESCRIPTION OF THE DRAWINGS

Figure 1A:
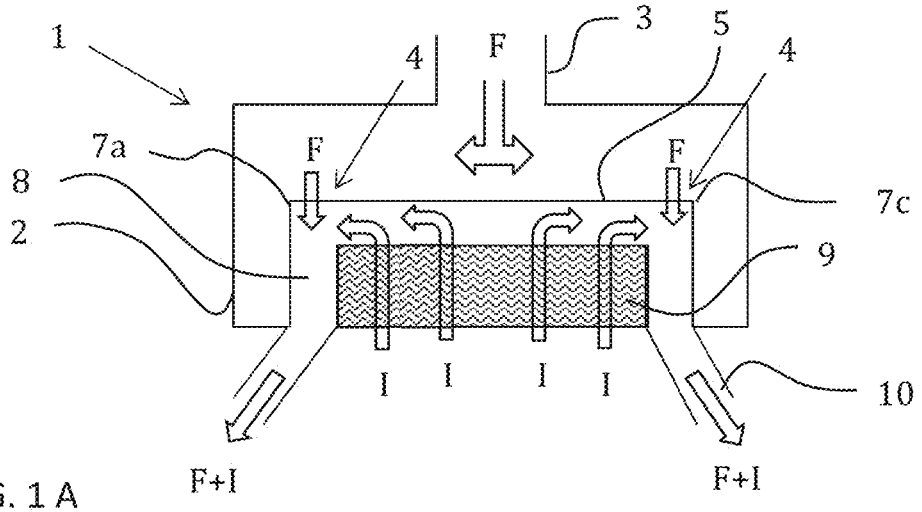
FIG. 1A discloses an air terminal device designed as an induction unit comprising an air temperature conditioner FIG. 1B discloses an air terminal device designed as an induction unit without temperature conditioning FIG. 1C discloses an air terminal device designed as an air diffuser without air temperature conditioner or induction arrangement FIG. 2A discloses an outlet surface provided with ordinary outlet openings having the same length FIG. 2B discloses an outlet surface provided with a mix of ordinary outlet openings and longer outlet openings FIG. 3A discloses an outlet surface as in FIG. 2A provided with cover plates when the cover plates are controlled to be in an open position FIG. 3B discloses an outlet surface as in FIG. 2A provided with cover plates when the cover plates are controlled to be in a covering position FIG. 4A discloses a circular outlet surface provided with cover plates when the cover plates are controlled to be in an open position FIG. 4B discloses a circular outlet surface provided with cover plates when the cover plates are controlled to be in a closed position

In FIG. 1A is disclosed an air terminal device 1 for delivering air to a space to be ventilated. The air terminal device 1 comprises a pressure box 2 connected to a supply air inlet 3 through which an air stream of supply air (F) enters. The supply air may for example be provided by a central Air handling Unit (AHU) (not shown) connected to the air terminal device via a ducting system. The pressure box 2 further comprises a multitude of outlet openings 4 located in an outlet surface 5 in the pressure box for delivering a flow of supply air (F) from the pressure box 2 to a mixing chamber 8. The outlet openings are located along a first edge 7*a* of the outlet surface 5 and a third edge 7*c*. The outlet surface 5 and the outlet openings 7*a*, 7*c* will be shown in detail in FIG. 2. When the supply air flows into the mixing chamber 8 will it induce a flow I from the space where the air terminal unit 1 is located via an air temperature conditioner 9, e.g. a heat exchanger having a liquid based heating media such as water for cooling or heating air passing through the heat exchanger. The induced flow I will mix with the supply air flow F in the mixing chamber where after a mixed flow F+I will be admitted from the mixing chamber 8 via air terminal outlets 10 to the space to be ventilated. Hence, the air terminal device 1 in FIG. 1 is designed as a cooling beam or comfort cassette for heating or cooling of an air to be admitted from the air terminal device 1.

Figure 1B:
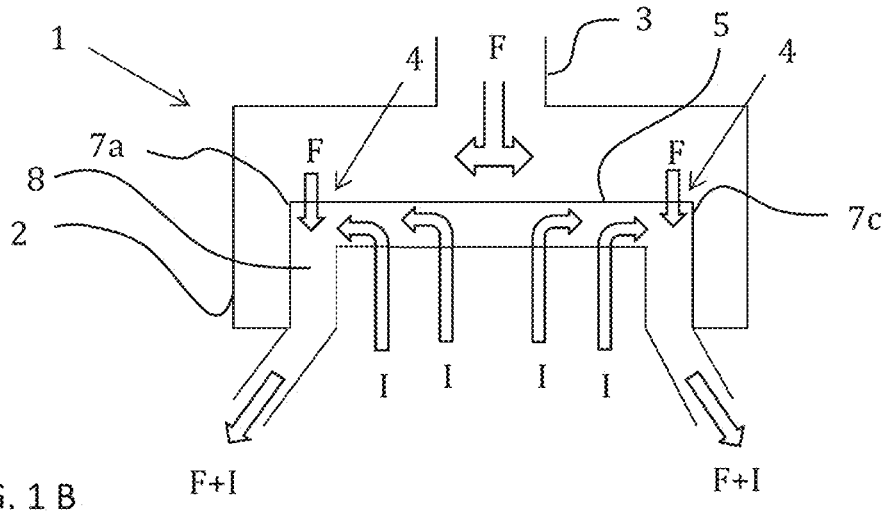

In FIG. 1*b* is disclosed a similar device but with the difference no air temperature conditioner 9 is included. Hence, this device works as an induction unit without any temperature conditioning. The induced air flow from the space to be ventilated will however help to improve the mixing of the air in the space and thus cause a more even temperature profile in the room and reduce hot or cold streams arising from the air terminal device.

Figure 1C:
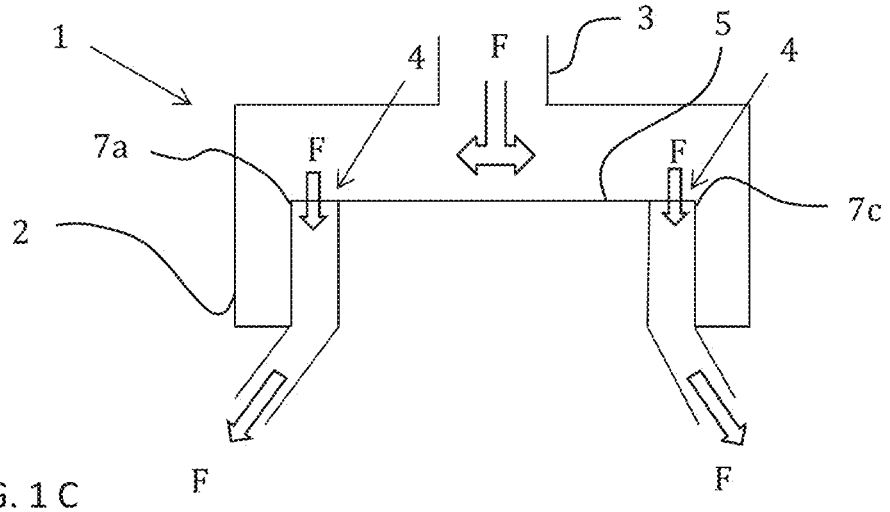

In FIG. 1*c* is disclosed still an alternative air terminal unit without air temperature conditioner or induction arrangement and thus will function as an ordinary air diffuser.

Figure 2A:
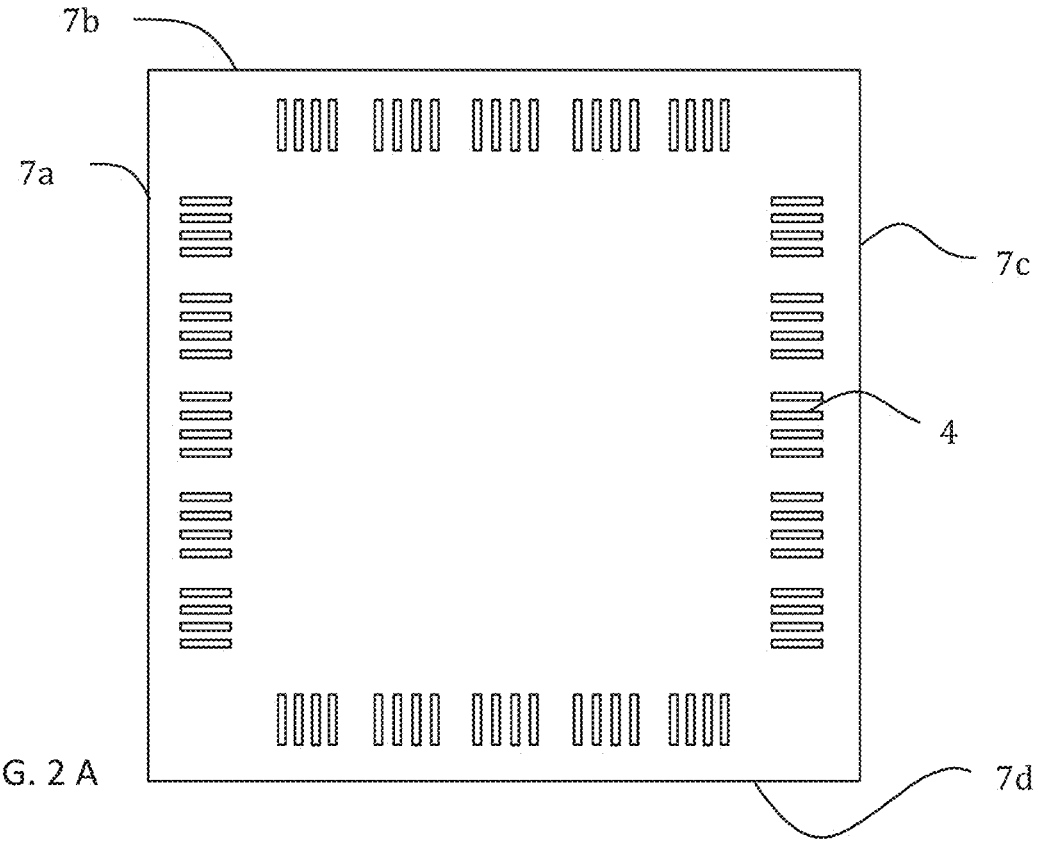
Figure 2B:
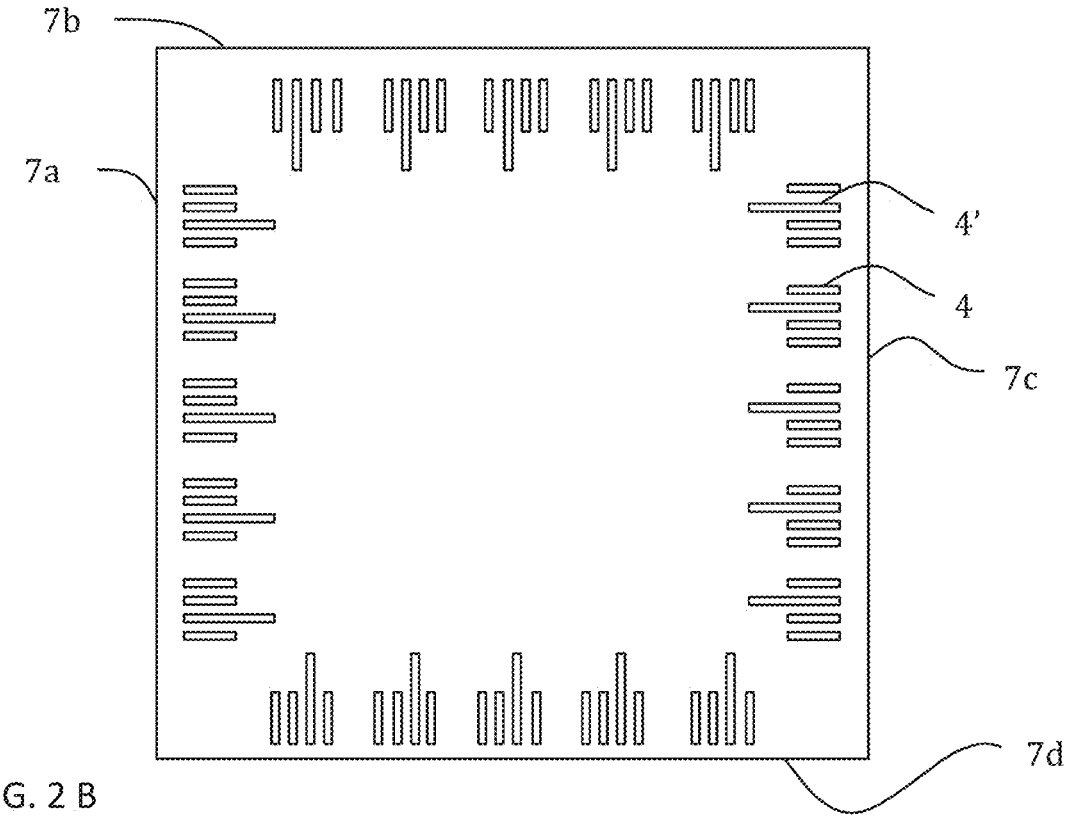

In FIG. 2A-B are disclosed two different configurations of outlet openings 4 in a square shaped outlet surfaces 5. In both FIG. 2*a* and FIG. 2*b* are there a multitude of outlet openings 4 along the first edge 7*a*, the second edge 7*b*, the third edge 7*c* and the fourth edge 7*d*. The outlet openings 4 are designed as elongated slits or slots having a longitudinal extension perpendicular to the extension of the edges 7*a-d* closest to the outlet openings.

The configurations in FIG. 2A and 2B differ in that in FIG. 2B are there some outlet openings 4' which are longer than the ordinary outlet openings 4. By this arrangement is it facilitated to have some outlet openings which are only partly open also when the cover plates (not shown, see FIG. 3) are set to maximum flow in order to keep the cover plate close to outlet surface 5 provided the cover plate is located on the high pressure side, i.e. inside the pressure box (see FIG. 1).

Hence, these outlet surfaces are suitable to be used in the devices in FIG. 1.

In FIG. 3 is disclosed the outlet surface 5 from FIG. 2A which has been provided with a first cover plate 6*a* and a second cover plate 6*b*. The outlet surface 5 has further been provided with a first actuating rod 11 attached to the first cover plate 6*a* at its first end 11*a* and attached to the second cover plate 6*b* at its second end 11*b* and having a pivotal point 11*c* attached at the centre of the first rod 11 to the outlet surface 5. Furthermore, the outlet surface 5 has also been provided with a second actuating rod 12 attached to the first cover plate 6*a* at its first end 12*a* and attached to the second cover plate 6*b* at its second end 12*b* and having a pivotal point 12*c* attached at the centre of the first rod 11 to the outlet surface 5.

Figure 3A:
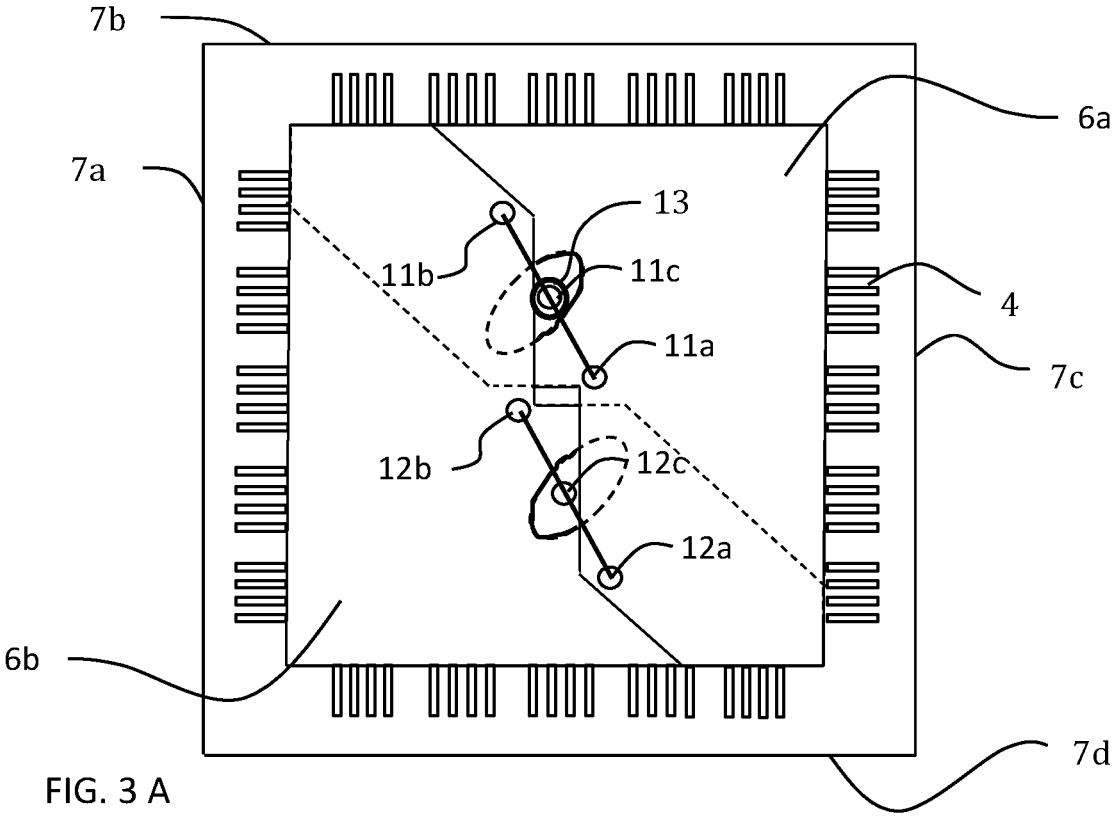

In FIG. 3A the cover plates are controlled to be in an open position and thus keeping the outlet openings 4 completely open. In this position is thus intended that a maximum flow is allowed to flow through the outlet openings 4.

Figure 3B:
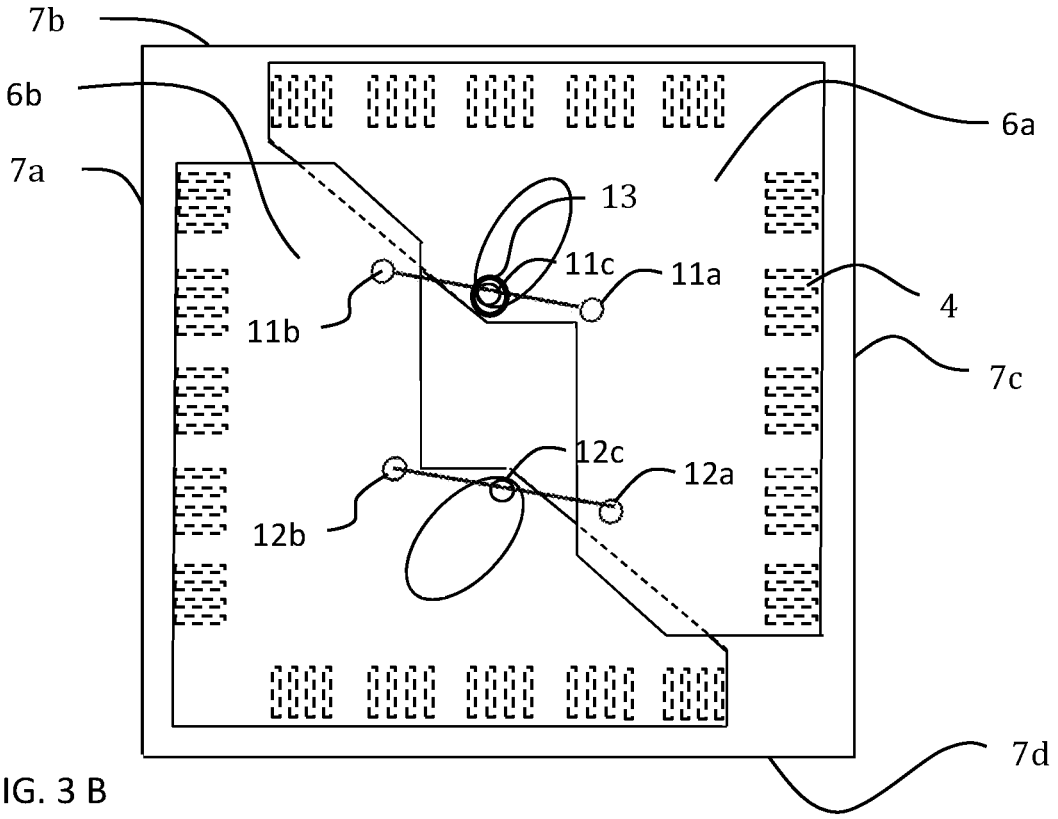

In FIG. 3B are the cover plates controlled to be in a covering position and thus completely covering the outlet openings 4. In this position is thus intended that no air should flow through the outlet openings 4.

The position in FIG. 3A is switched by turning the actuating rods 11, 12 about 40-50 degrees counter clockwise. The actuating rods 11, 12 will thus cause the cover plates 6*a*, 6*b* to move in different directions by a rotating movement. As can be understood by the positioning of the rods in FIG. 3A respectively FIG. 3B will the plates, when changing from the position in FIG. 3A to the position in FIG. 3B, first move more in the lateral direction, i.e. changing its distance relative the lateral edges 7*a*, 7*c* while at the end of the transition move more in a straight direction, i.e. changing its distance relative the other edges 7*b*, 7*d*. However, by designing the rotational movement adequately it may be possible to provide an almost uniform motion. In order to return to from the closed position in FIG. 3B is the actuating rods turned back, clockwise, the same degrees (40 to 50 degrees). An actuator 13 causing a rotational movement may thus be connected to either of the actuating rods 11, 12 in order to provide a rotation, e.g. to the first actuating rod. The other actuating rod, e.g. the second actuating rod, will thus be forced to turn around its pivotal point 12*c* due to its attachment to the cover plates 6*a*, 6*b* at its ends 12*a*, 12*b*. The second actuating rod 12 will functions as a guiding member in order to assure the cover plates 6*a*, 6*b* will move as desired.

In these figures, only the extreme positions are disclosed, i.e. when the devices are set to maximum flow or completely shut off. The number of intermediate positions depends on the actuator; if the actuator is analogue there may be an endless number of intermediate positions thus allowing the cover plates 6*a*, 6*b* to change the flow of air through the outlet surface by step less motion. In case the actuator is moved stepwise, it may have predefined positions with a known configuration of the coverage of the outlet openings such that an air flow may be calculated from these known positions and a pressure difference between the pressure box and the outside pressure.

Figure 4A:
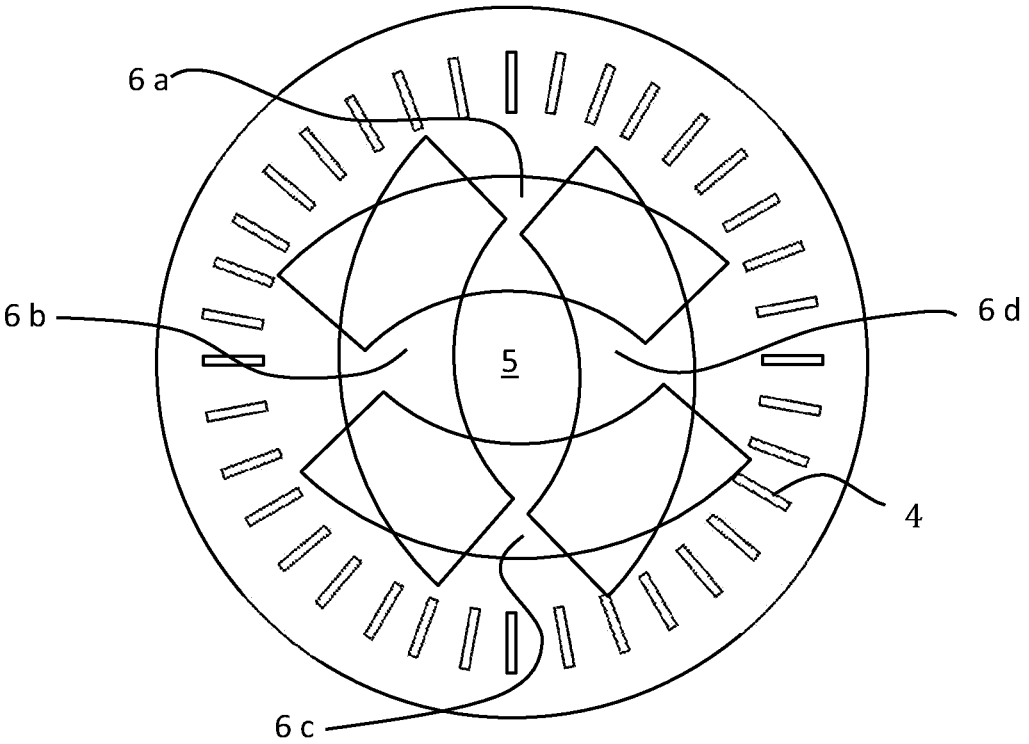
Figure 4B:
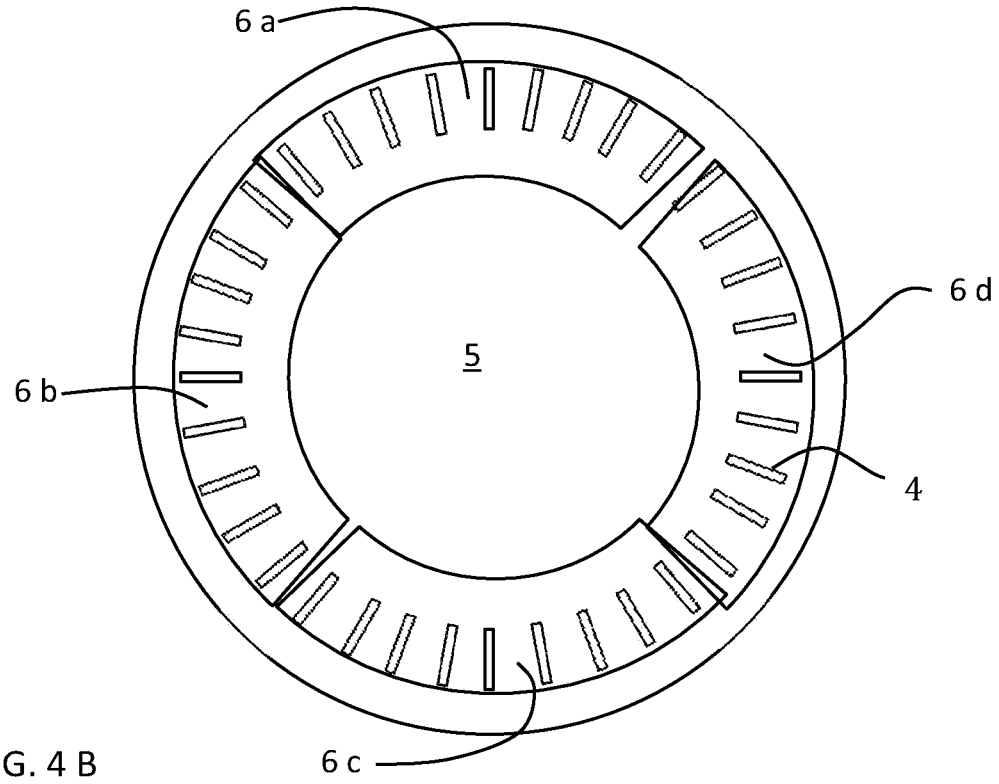

FIG. 4 discloses a device which is circular and having a circle shaped outlet surface 5 having 4 cover sheets 6*a*-6*d* which are positioned in an open position in FIG. 4A and in a closed position in FIG. 4B.

The invention claimed is:

1. An air terminal device for a ventilation system, e.g. a Heating and Ventilation Air Conditioning (HVAC) system, for a building, said air terminal device comprising:

a pressure box, provided with at least one inlet for admitting supply air into the pressure box and a plurality of outlet openings for admitting supply air out of the pressure box, a first cover plate, and a second cover plate, wherein each of the first and second cover plates is arranged to control and change the open area of a plurality of said outlet openings, and said plurality of outlet openings are arranged on an outlet surface of the pressure box, wherein the first cover plate and the second cover plate are arranged to slide relative each other and to be in contact with and slide relative the outlet surface while changing the open area of the outlet openings, wherein the plurality of outlet openings are arranged on an outlet surface having at least four edges, including a quadratic or rectangular surface, and there are provided outlet openings along at least four edges, and wherein the first cover plate is arranged to change the area of the outlet openings for openings along a first edge and a second edge being adjacent to each other, and wherein the second cover plate is arranged to change the area of the outlet openings for openings along a third edge and a fourth edge being adjacent to each other, by the first and second cover plates being arranged to change the configuration at all groups outlet openings simultaneously by moving the first and second cover plates in different directions.

2. The air terminal device according to claim 1, wherein said plurality of outlet openings are arranged along one or several edges of the outlet surface.

3. The air terminal device according to claim 2, wherein said area of the outlet openings are changed to be smaller by moving the first and second cover plates towards the edge or edges of the outlet surface.

4. The air terminal device according to claim 3, wherein said plurality of outlet openings are shaped as elongated slits.

5. The air terminal device according to claim 2, wherein said plurality of outlet openings are shaped as elongated slits.

6. The air terminal device according to claim 1, wherein said plurality of outlet openings are shaped as elongated slits.

7. The air terminal device according to claim 6, wherein said elongated slits are arranged such that their longitudinal extension direction is angled less than 30 degrees relative its closest edge.

8. The air terminal device according to claim 6, wherein said elongated slits are arranged such that their longitudinal extension direction is angled less than 30 degrees relative its closest edge, arranged such that their longitudinal extension direction is essentially perpendicular to the extension direction of the closest edge.

9. The air terminal device according to claim 1, wherein said first and second cover plates are arranged to move non linearly, e.g. by a circular or orbital motion, when sliding in order to change the area of the outlet openings.

10. The air terminal device according to claim 9, wherein the first and second cover plates are moved by a rotating actuator.

11. The air terminal device according to claim 10, wherein the outlet surface has been provided with a first actuating rod attached to the first cover plate at its first end and attached to the second cover plate at its second end and having a pivotal point attached at the centre of the first rod to the outlet surface, said first actuating rod being connected to the rotating actuator so as to be rotated around its pivotal point.

12. The air terminal device according to claim 11, wherein the outlet surface has also been provided with a second actuating rod attached to the first cover plate at its first end and attached to the second cover plate at its second end and having a pivotal point attached at the centre of the second rod to the outlet surface, said second actuating rod caused to rotate by the movement of the first and second cover plates induced by the first actuating rod.

13. The air terminal device according to claim 1, wherein the first cover plate is arranged to change the area of the outlet openings for openings along a first edge and a second edge being adjacent to each other and whereby the second cover plate is arranged to change the area of the outlet openings for openings along a third edge and a fourth edge being adjacent to each other.

14. The air terminal device according to claim 1, wherein the outlet openings are directed to a mixing chamber where to a stream of air from the space to be ventilated is induced by the flow of the supply air through the outlet openings such that the stream of supply air is mixed with room air.

15. The air terminal device according to claim 1, wherein the air terminal device is provided with an air temperature regulating device in order to condition the air flowing through the air terminal device.

16. The air terminal device according to claim 1, wherein there is at least one outlet opening being partly covered by one of the first and second cover plates also when the device is set to a maximum flow.

17. The air terminal device according to claim 1, wherein said first and second cover plates are made of a thin flexible sheet having a thickness of 0.15 to 0.60 mm made of a polymer.

18. The air terminal device according to claim 17, wherein said first and second cover plates are located on the high pressure side of the outlet surface.

19. The air terminal device according to claim 1, wherein said first and second cover plates are made of a thin flexible sheet.

* * * * *